US005967955A

United States Patent [19]

Westfall et al.

[11] Patent Number: 5,967,955

[45] Date of Patent: Oct. 19, 1999

[54] COLLAPSIBLE EXERCISE DEVICE

[75] Inventors: Larry Westfall; Thomas Campanaro, both of San Diego, Calif.; Thomas A. Walter, Cologne; James A. Kalthoff, Waconia, both of Minn.; Spencer Mackey, No. Hollywood, Calif.

[73] Assignee: Total Gym Fitness, Ltd., West Chester, Pa.

[21] Appl. No.: 08/848,993

[22] Filed: May 2, 1997

[51] Int. Cl.[6] ..... A63B 21/02

[52] U.S. Cl. ..... 482/142; 482/96; 482/95

[58] Field of Search ..... 482/96, 142, 95, 482/130

[56] References Cited

U.S. PATENT DOCUMENTS

| | | | |
|---|---|---|---|
| D. 280,537 | 9/1985 | Law . | |
| D. 284,597 | 7/1986 | Smith et al. . | |
| 339,638 | 4/1886 | Goldie . | |
| D. 347,251 | 5/1994 | Driebelbis et al. . | |
| D. 356,839 | 3/1995 | Ferdinand . | |
| D. 362,700 | 9/1995 | Breibart et al. . | |
| D. 382,319 | 8/1997 | Gerschefske et al. . | |
| 3,586,322 | 6/1971 | Kverneland . | |
| 3,658,327 | 4/1972 | Thiede . | |
| 3,709,487 | 1/1973 | Walker . | |
| 3,892,404 | 7/1975 | Martucci . | |
| 4,004,801 | 1/1977 | Campanaro . | |
| 4,101,124 | 7/1978 | Mahnke . | |
| 4,383,684 | 5/1983 | Schliep . | |
| 4,706,953 | 11/1987 | Graham . | |
| 4,911,438 | 3/1990 | Van Straaten . | |
| 4,930,769 | 6/1990 | Nenoff | 272/120 |
| 5,169,363 | 12/1992 | Companaro et al. . | |
| 5,232,426 | 8/1993 | Van Straaten . | |
| 5,620,403 | 4/1997 | Lundin | 482/96 |
| 5,649,885 | 7/1997 | Liljenquist et al. | 482/96 |

FOREIGN PATENT DOCUMENTS 2 133 706 1/1984 United Kingdom .

OTHER PUBLICATIONS

Brochure Advertising Total Gym Therapy System, 1 page (1995).

Tracy L. Voelkerding et al., "A Closer Look At Sqatting Exercises: Standing vs. Inclined," *Physical Therapy Products*, pp. 69–72 (Sep. 1994).

*Primary Examiner*—Jerome W. Donnelly

*Attorney, Agent, or Firm*—Finnegan, Henderson, Farabow, Garrett & Dunner, L.L.P.

[57] ABSTRACT

An exercise device is provided as a set of inner rails pivotally connected to a slide bar adjustably supported by a vertical support member and a set of outer rails pivotally connected to the set of inner rails at a rail pivot point with a strut pivotally connected to the vertical support member and the rail pivot point. A user support platform is rollable along the inner and outer rails when the inner and outer rails are extended from the vertical support member. Pulley means are connected to the vertical support member and a connector means extends through the pulley means to the user support platform allowing an exerciser positioned on the user support platform to propel the exerciser along the inner and outer rails. The exercise device may include a foot rest at one end of the outer rails allowing for additional exercising. The exercise device may also include a foot harness attached to the connector means to allow for additional exercise use. The exercise device may also include a footholder or pull up bars attachable to the inner rails to allow for additional exercising use. When in non-use, the exercise device is foldable to allow for easy storage.

15 Claims, 8 Drawing Sheets

COLLAPSIBLE EXERCISE DEVICE

BACKGROUND OF THE INVENTION

The present invention relates to an exercise device. More particularly, the present invention relates to an exercise device wherein the exerciser exerts muscle force against an adjustable portion of the exerciser's own body weight.

DESCRIPTION OF RELATED ART

Home exercise is becoming increasingly more popular. Home exercise offers the health benefits of regular exercise while recognizing that many people have difficulty in finding sufficient time in their schedule for a full workout at a health club or gymnasium. An exerciser may exercise at home whenever the exerciser's schedule permits. This flexibility in scheduling often allows for a more consistent and thus healthful exercise regime.

Home exercise, however, has its drawbacks. In particular, in order to exercise all or most of the muscle groups, multiple pieces of home exercise equipment may be required. Furthermore, these multiple pieces of equipment may require permanent installation in the exerciser's home.

Permanent or not, many popular pieces of home exercise equipment occupy a great deal of space. This makes the use of this equipment impractical in homes or apartments which do not have the required extra space. Furthermore, non-permanent pieces of equipment are often difficult to disassemble and may require much storage space even when disassembled. A user must then often choose between an exercise device providing a complete exercise regime and a device which fits the exerciser's home space.

There is, thus, a need for exercise equipment which may be easily stored when not in use, does not occupy a great deal of space when in use and provides for exercising all or most of the muscle groups.

Exercise devices are known in which a user, positioned on a support platform, propels that support platform up an inclined ramp. One way by which the platform may be propelled is by pulling a cable connected to the support platform through a variety of pulleys positioned on the exercise device. By changing positions on the platform and by changing the method by which the platform is propelled, a user can exercise multiple muscle groups.

While early versions of these devices did not allow for easy storage, later designs were proposed that allowed for some type of disassembly in the design. Even the later designs do not, however, provide complete foldability of the exercise unit. The designs include some separate elements which must be disengaged to allow for foldability of the device. Thus, these designs cannot be folded and stored as a unit. Moreover, the designs are not easily converted from the folded stored state to an unfolded state for use.

In view of the foregoing, there is a need for an inclined ramp exercise device which is easily foldable to a size which allows for easy storage, is easily unfolded into a useable state, and which allows for exercising multiple muscle groups.

SUMMARY OF THE INVENTION

Accordingly, the present invention is directed to a exercise device that substantially obviates one or more or the problems due to limitations and disadvantages of the related art.

The principal advantage of the present invention is the provision of an arrangement which substantially obviates one or more of the limitations and disadvantages of the prior art. Additional features and advantages of the invention will be set forth in the description which follows, and in part shall be apparent from the description, or may be learned by practice of the invention. The objectives and other advantages of the invention will be realized and obtained by the apparatus particularly pointed out in the written description and claims hereof as well as the appended drawings.

To achieve these and other advantages and in accordance with the purpose of the invention, as embodied and broadly described, the invention is an exercise device with a vertical support member, a first set of rails which are pivotally connected to, and adjustably supported by, the vertical support member, a second set of rails with one end pivotally connected to the first set of rails at a rail pivot point, a strut which is pivotally connected to the vertical support member and pivotally connected to the rail pivot point, a user support platform with a first and second set of rollers engaging said first and second set of rails, a pulley means and a connector means extending through the pulley means and connecting to the support platform.

The exercise device is foldable such that the vertical support member, first and second set of rails and the strut are substantially parallel to each other. When unfolded, however, the first and second set of rails extend from the vertical support member so as to be aligned such that the user support platform is rollable along the first and second set of rails. Furthermore, when the connector means is extended through the pulley means, the user support platform rolls upwards along the first and second set of rails.

In another aspect, the invention includes a vertical support member, a slide bar slidable along and adjustably supported by the vertical support member, a set of inner rails pivotably connected to the slide bar, a set of outer rails pivotably connected to the inner rails at a rail pivot point, a strut pivotably connected to the lower portion of the vertical support member and pivotably connected to the inner rails at the rail pivot point, a user support platform with rollers engaging the inner and outer set of rails, a pulley means, and a connector means extending through the pulley means and connecting to the user support platform.

The exercise device is foldable such that the vertical support member, the inner set of rails, the outer set of rails, and the strut are substantially parallel to each other. Furthermore, the exercise device may be unfolded by extending the inner and outer set of rails from the vertical support member so that the inner and outer set of rails are aligned such that the user support platform is rollable along the rails. Furthermore, when the connector means is extended through the pulley means, the user support platform rolls upwards along the first and second set of rails.

It is understood that both the foregoing general description and following detailed description are exemplary and explanatory and are intended to provide further explanation to the invention as claimed. The accompanying drawings are included to provide a further understanding of the invention and are incorporated in and constitute a part of this specification, illustrate several embodiments of the invention and together with the description serve to explain the principles of the invention.

BRIEF DESCRIPTION OF DRAWINGS

The accompanying drawings, which are incorporated in and constitute a part of the specification, illustrate embodiments of the invention and, together with the description, serve to explain the objects, advantages, and principles of the invention. In the drawings.

DETAILED DESCRIPTION

Reference will now be made in detail to the present preferred embodiments of the invention, examples of which are illustrated in the accompanying drawings.

Figure 1:
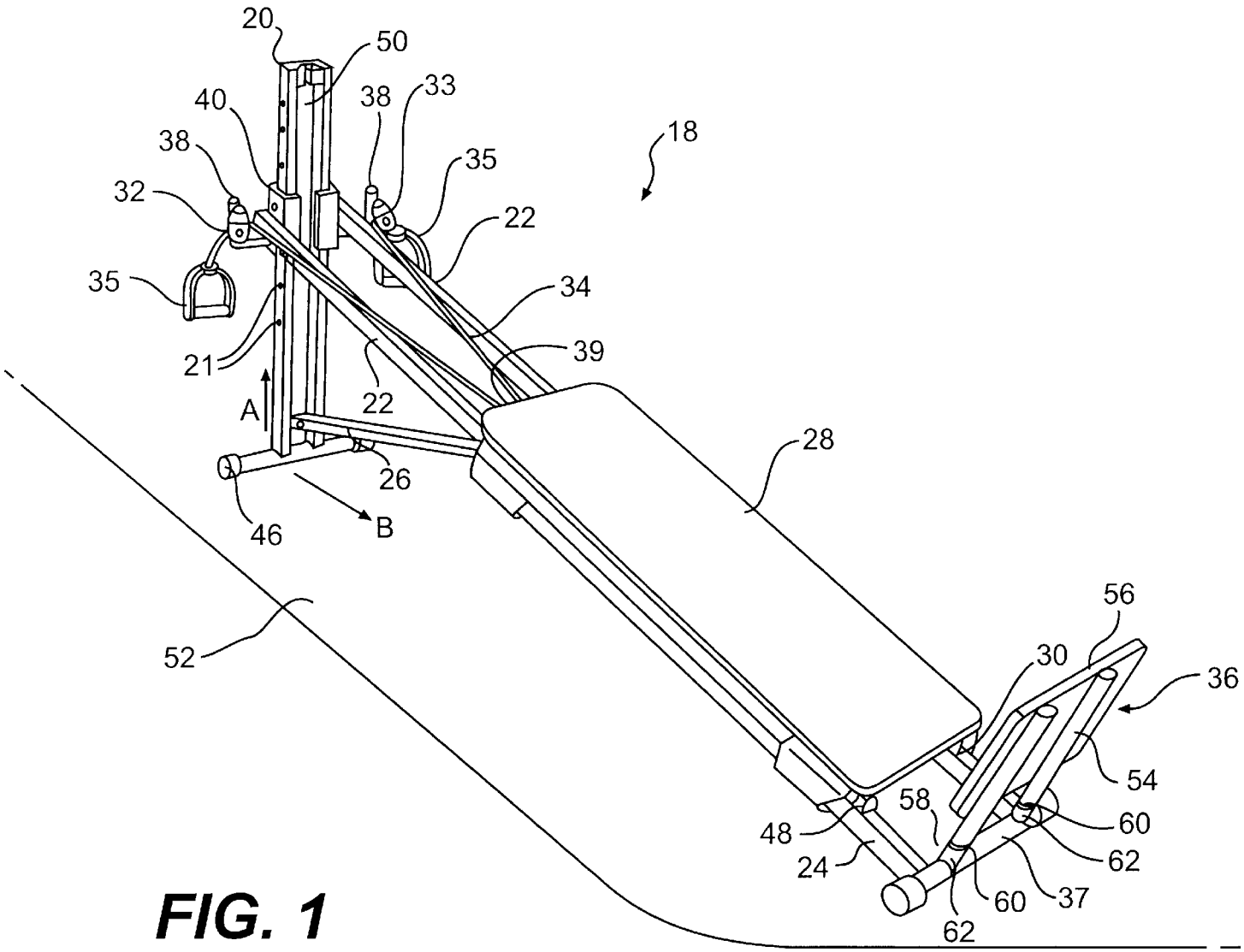
FIG. 1 is a perspective view of a device in which the present invention is embodied.

The exemplary embodiment of the exercise device of the present invention is shown in an unfolded state in FIG. 1 and is designated generally by reference numeral 18.

Figure 8A:
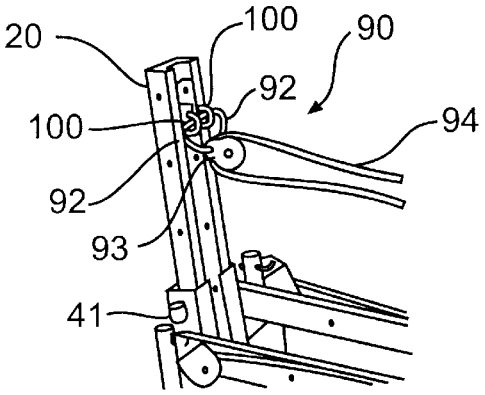
FIG. 8A is a partial perspective view of an alternate embodiment of the invention.
Figure 9:
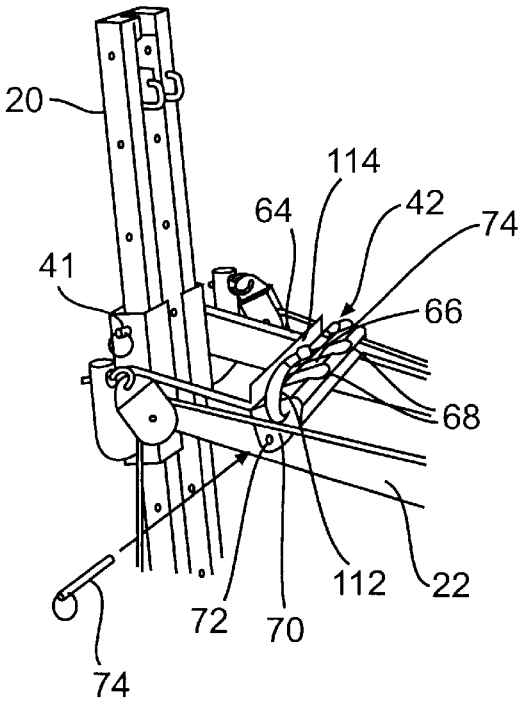
FIG. 9 is a partial perspective view of an alternate embodiment of the invention.

As embodied herein and shown in FIG. 1, the collapsible exercise device 18 includes a vertical support member 20. A slide bar 40 is slidable along the vertical support member 20. The slide bar 40 may be supported by the vertical support member 20 at various points 21 along the vertical support member 20. The slide bar 40 may be supported along the vertical support member 20 by any suitable means, but is shown in FIGS. 8A and 9, by way of example, as being supported by a lock pin 41. The lock pin 41 is inserted through the slide bar 40 into any of the support points 21.

The slide bar 40 is pivotably connected to an inner set of rails 22. An outer set of rails 24 is pivotably connected to the second end of the inner set of rails 22 at a rail pivot point 23. A strut 26 is pivotably connected to the lower portion of the vertical support member 20 and is also pivotably connected to the rail pivot point 23.

In an alternate embodiment, the inner set of rails 22 may be pivotally connected directly to, and adjustably supported by, the vertical support member 20.

In an alternate embodiment, one end of the strut 26 may be pivotally connected to the rail pivot point 23, while the other end rests on a support platform such as a floor 52.

A user support platform 28 with rollers 30 engaging the inner and outer set of rails 22 and 24 is positioned on the inner and outer set of rails 22, 24. A bumper 48 is positioned on the outer rail to prevent the user support platform 28 from rolling all the way down the outer rails 24.

As shown in FIG. 1, the invention includes pulley support bars 38 extending from opposite sides of the slide bar 40. Attached to the pulley support bars are the first pulley 32 and second pulley 33. Preferably, the pulley support bars 38 are L-shaped and extend out from the slide bar 40 in a direction perpendicular to both the slidable direction A of the slide bar 40 and the direction B in which the exercise device unfolds. The pulley support bars 38 extend outward from the slide bar 40 beyond the outer edge of the inner rails so as not to interfere with the rotational movement of the inner rails 22 about the slide bar 40.

The invention also includes a connector extending through the pulleys 32 and 33 and connecting to the user support platform 28. The connector may be of any suitable well-known type, but shown by way of example in FIG. 1 is a cable 34. Cable 34 includes handles 35 at each end and extends through the pulleys 32 and 33 positioned on the pulley support bars 38 and loops through a third pulley 39 attached to the user support platform 28. The third pulley 39 is positioned along the lateral centerline of the user support platform 28. This position allows for unilateral (i.e. one arm), bilateral (i.e., two arm) and static equilibrium (i.e. holding the user support platform 28 suspended by keeping a constant force on each handle 35) use.

The cable should preferably be of sufficient length to extend through the pulleys 32, 33 and allow the exerciser to grasp one or both of the handles 35 while the exerciser is on the user support platform 28 and the user support platform 28 is at rest.

In an alternate embodiment, the connector may be two separate cables extending through the pulleys 32, 33 with each cable fixedly attached to the user support platform 28.

In an alternate embodiment, the invention includes a foot harness 88 and pulley assembly 90 for use with leg pull-up exercises. The pulley assembly 90 includes a D-shaped ring 92 attached to the pulley 93. A cable 94 with a first O-ring (not shown) at one end and a clip 98 at the other end is also included in the pulley assembly 90.

In use, the D-shaped ring 92 is attached to the upper part of the vertical support member 20 at the L-shaped brackets 100. The first O-shaped ring (not shown) is then attached to the user support platform 28. Foot harness 88 is attached to the clip 98.

Figure 8B:
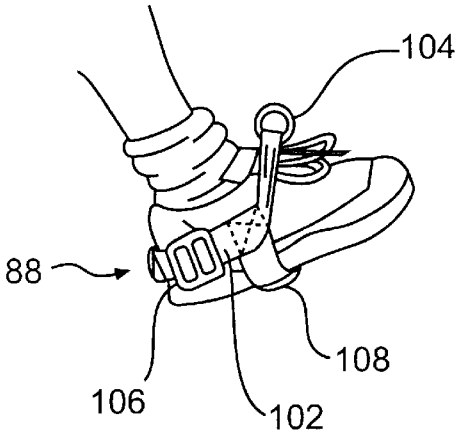
FIGS. 8B and 8C are perspective views of a foot harness used with the embodiment shown in FIG. 8A.
Figure 8C:
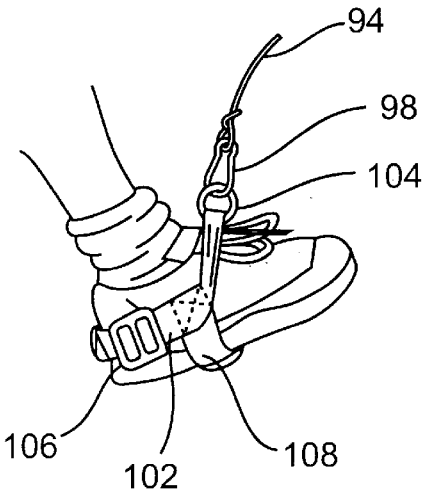

As shown in FIGS. 8A–8C, the foot harness 88 includes a belt 102 looped through a second O-ring 104 and adjustably buckled by a buckle 106. A separate belt section 108 is attached perpendicular to the belt 102. The foot harness 88 is then attached to the cable 94 through the O-ring 104.

In the embodiment of the invention shown in FIG. 1, a footrest 36 is positioned perpendicular to the second end of the outer set of rails when the collapsible exercise device is in an unfolded state. The footrest 36 is preferably removable. As shown in FIG. 1, footrest 36 is removably attached to cross member 37. Footrest 36 includes support bars 54 and pressure plate 56. Pressure plate 56 is generally of a rectangular shape. The footrest 36 is attached to the cross member 37 by a coupling 58. The coupling 58 includes a male end of each cross member 37 which is inserted into a female coupling end 62 mounted on the cross member 37.

As shown in FIG. 9, another embodiment of the invention includes a foot holder 42 removably attached to the inner set of rails 22. Foot holder 42 is attached to the center portion of the inner set of rails 22. The foot holder 42 includes a back plate 64 and a bottom surface 66 positioned perpendicular to the back plate 64. The bottom surface 66 includes two arcuate indentations 68.

Footholder 42 also includes side plates 70 extending away from each end of the bottom surface 66. Each side plate 70 includes a pin hole 72. The footholder 42 is of a dimension such that the distance between the side plate 70 is equal to or slightly greater than the distance from the outer edges of each of the inner set of rails 22. Therefore, the footholder 42 may be positioned over the inner set of rails 22 and attached thereto by means of lock pins 74 inserted through the pin holes 72.

Preferably, a belt 112, loops through the side plates 70 and over the bottom surface 66. Each end of the belt 112 is adjustably attached to the other end by a buckle 114.

Figure 5:
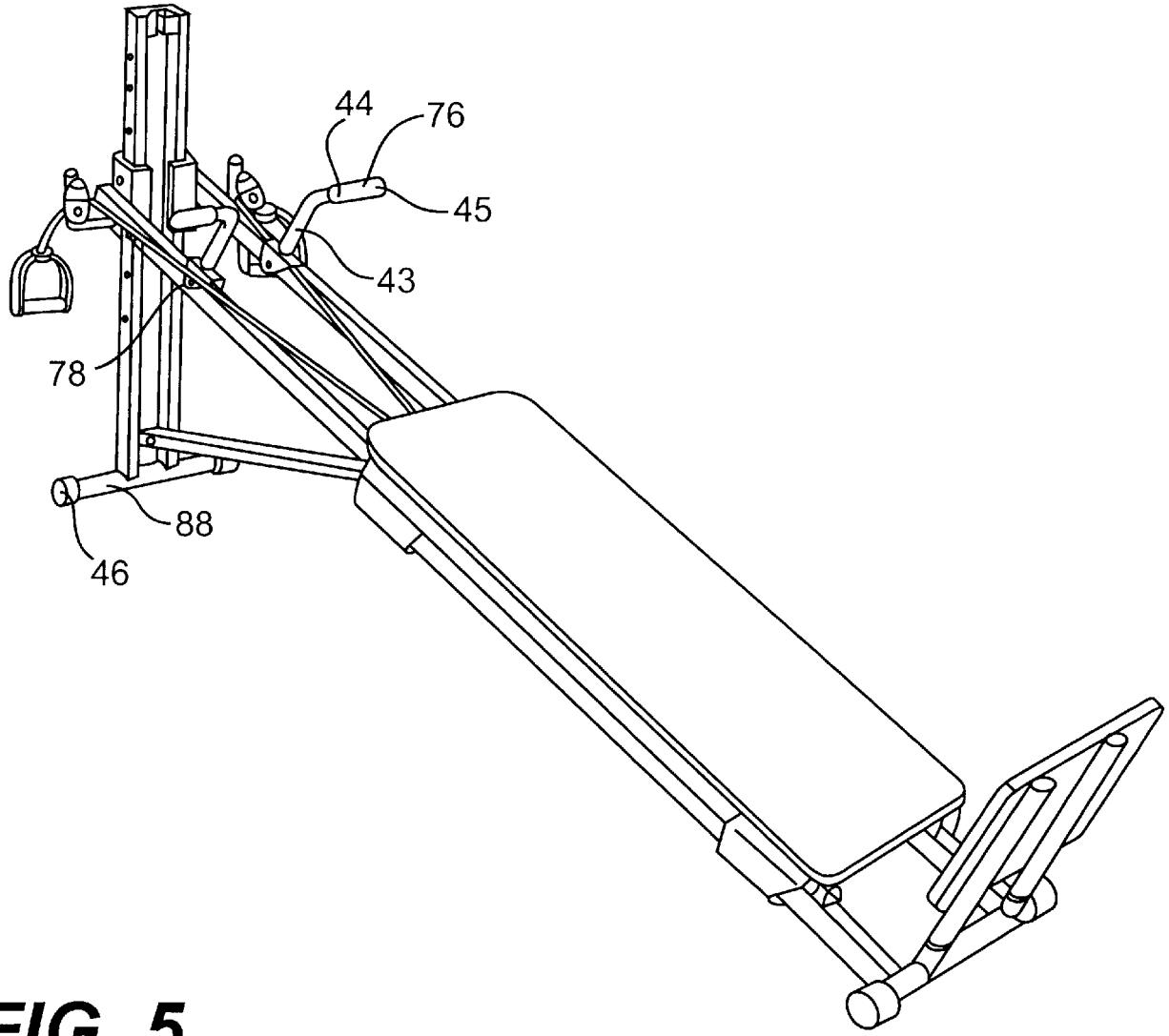
FIG. 5 is a perspective view of an alternate embodiment of the invention.

Shown in FIG. 5, another embodiment of the invention includes pull-up bars 44 removably attachable to the inner set of rails 22. As shown, the pull-up bars 44 are L-shaped consisting of a first part 43 extending perpendicularly from the inner rail 22 and a second part 45 perpendicular to the first part 43 and directed outwardly from the inner rails 22. Preferably, as shown, the portion 45 includes a hand grip 76.

Figure 6:
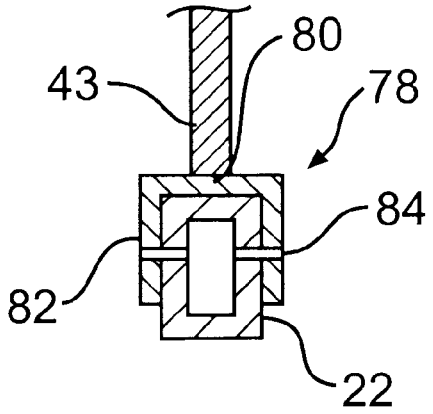
FIG. 6 is a partial cross-sectional view taken on line 6—6 of FIG. 7.
Figure 7:
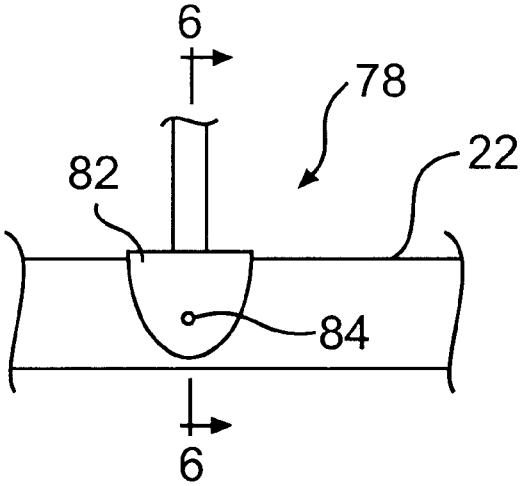
FIG. 7 is a partial side view of the side plate 82, depicted in FIGS. 5 and 6.

Each pull-up 44 is attached to each inner rail 22 by means of a coupling 78. As shown in FIGS. 6–7, the coupling 78 includes a generally rectangular top plate 80 positioned perpendicular to the end of the first part 43 of the pull-up bar 44. The coupling also includes two side plates 82 positioned perpendicular to each side of the top plate 80 and extending away from the pull-up bar 44. Each side plate 82 includes a lock pin hole 84. When attached to the inner rails, the side plates 82 are positioned around each inner rail and a lock pin (not shown) is inserted through the lock pin holes 84 and the inner rail 22.

In another embodiment of the invention, the vertical support member 20 includes a bottom bar 88 allowing the vertical support member 20 to be rollable along a support platform such as a floor 52 when unfolding the exercise device. Cross bar 88 extends laterally beyond the sides of the vertical support member 20. Preferably, the length of the cross bar 88 is slightly greater than the width of the user support platform 28. Also, preferably, the cross bar 88 includes rollers 46.

Figure 3:
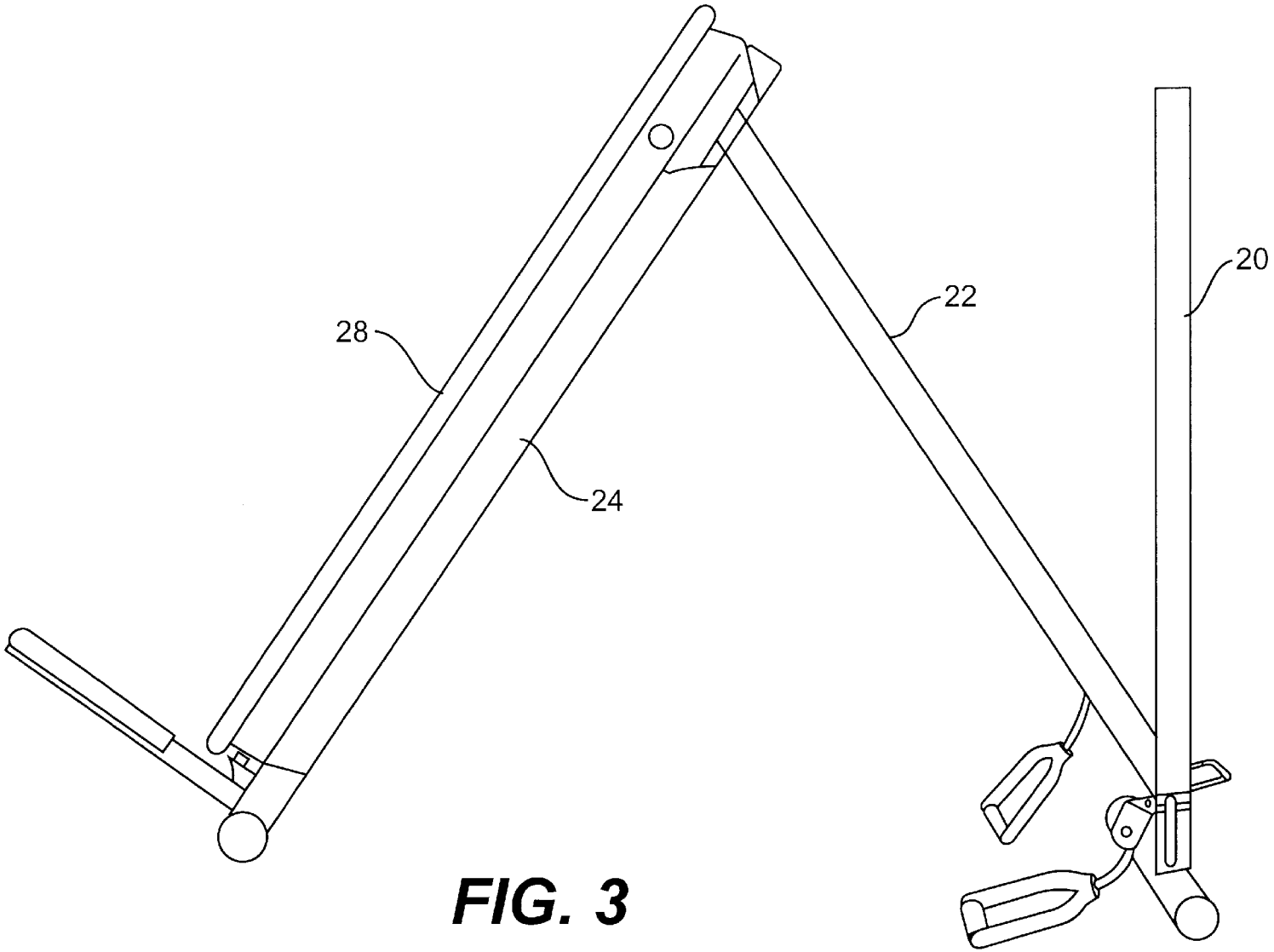
FIG. 3 is a side elevation of the device shown in FIG. 1 in a semi-folded state.

The details of this invention are described below. As described, the exercise device 18 is foldable such that the vertical support member 20, the strut 26, the inner set of rails 22, and the outer set of rails 24 are substantially parallel when the device is folded. FIG. 3 shows the collapsible exercise device in a semi-folded state. The slide bar 40 is lowered to the bottom of the vertical support member 20. The rail pivot point is then drawn up away from the floor 52 while the rollers 46 roll along the floor 52.

Figure 4:
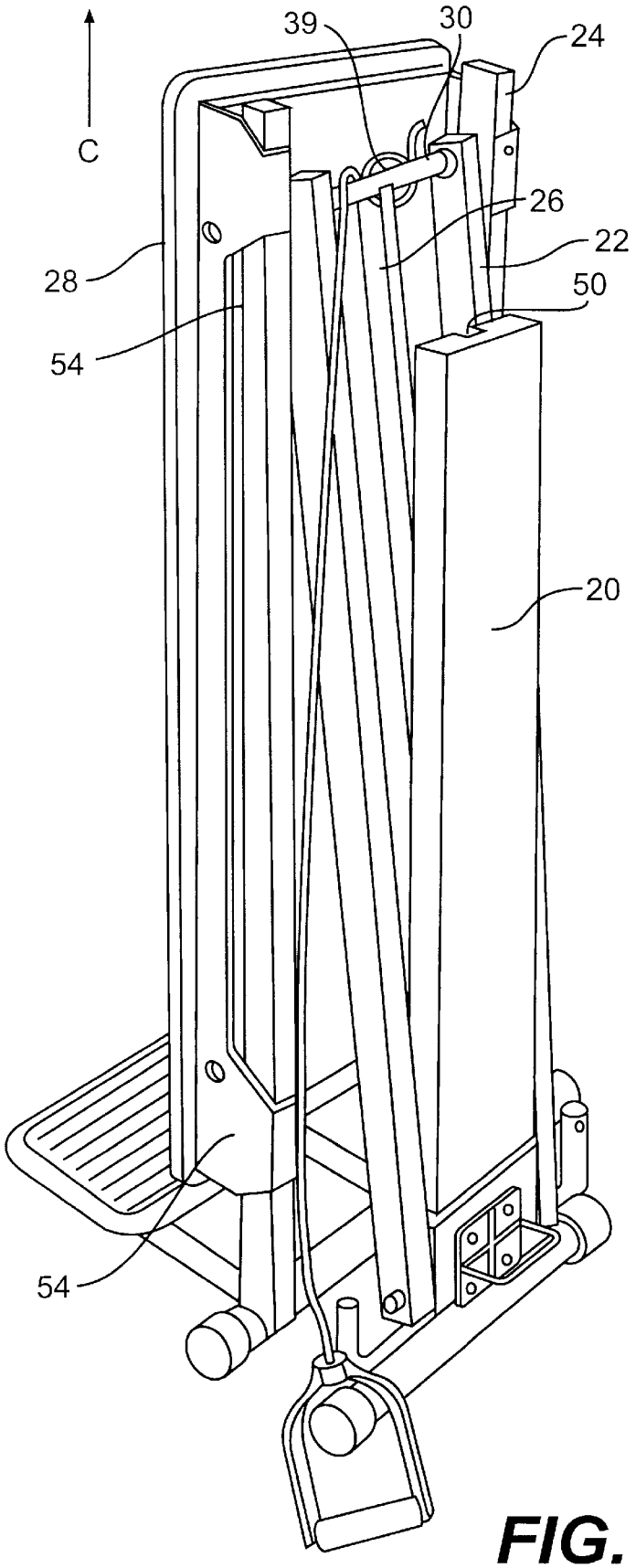
FIG. 4 is perspective view of the device shown in FIG. 1 in a folded state.

FIG. 4 shows the invention in a fully folded state wherein the vertical support member 20, the strut 26, the inner set of rails 22, the outer set of rails 24 are substantially parallel. As can be seen, in a preferred embodiment, the vertical strut 20 includes a groove 50 in which the strut 26 can be inserted upon complete folding of the exercise device.

FIG. 4 also shows that the user support platform 28 preferably includes retaining elements 54 extending around the outer set of rails in the folded state. The retaining elements 54 act to retain the user support platform 28 to the outer set of rails while folded. The user support platform 28 may, however, be rolled up (in direction C) and off of the collapsed exercise device.

Also, in the preferred embodiment the strut 26 includes an element 31 that is pivotably connected to the inner side of the inner rails 22 at the rail pivot point 23.

Figure 10A:
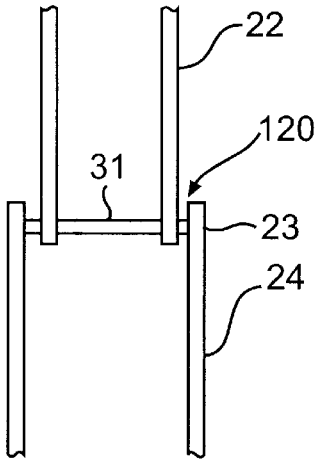
FIG. 10A is a partial top plan view of the invention in an unfolded state.
Figure 10B:
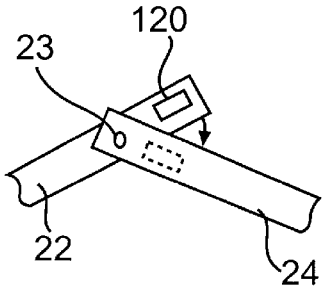
FIG. 10B is a partial side elevational view of the invention in an semi-folded state.

To unfold the exercise device 18, the bottom of the vertical support member 20 is rolled away from the outer set of rails 24. As shown in FIG. 10, in the unfolded state, tabs 120 positioned at the inner side of the first end of the outer set of rails 24 and at the outer side of the second end of the inner set of rails 22 act to hold the inner and outer rails in a straight path.

Once the inner and outer set of rails 22, 24 are extended along the floor 52, the vertical support member is pivoted upward so as to be perpendicular to the floor 52. Slide bar 40 may then be adjusted up the vertical support member 20. The slide bar may be positioned at various preselected points 21 along the vertical support member 20.

In use, the exerciser positions himself or herself on the user support platform 28 and grasps one or both of the handles 35. The exerciser then draws one or both of the handles toward the exerciser and by doing so transports the user support platform up along the inner and outer rails 22 and 24.

Figure 2:
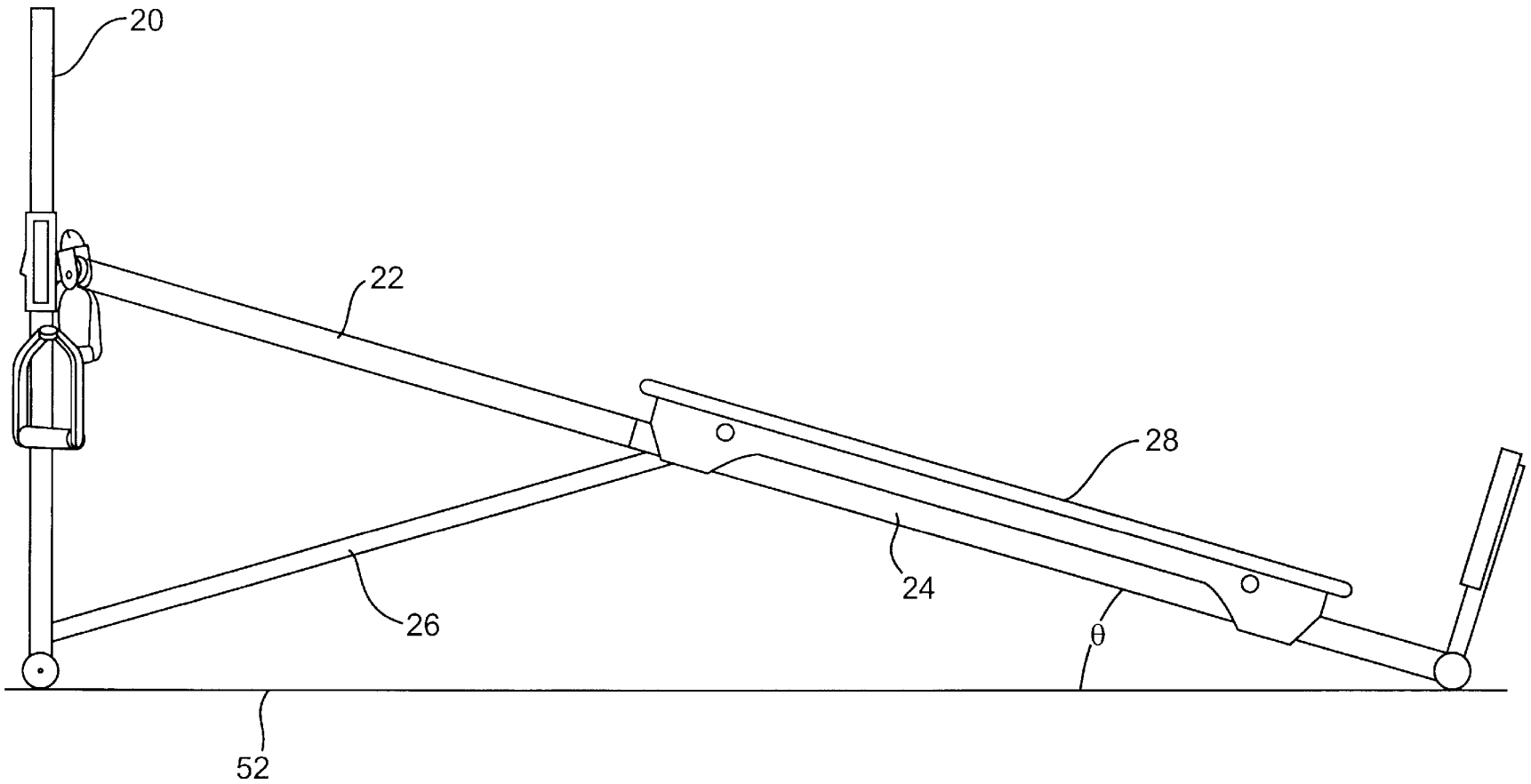
FIG. 2 is a side elevation of the device shown in FIG. 1.

By varying the support point 21 along the vertical support member 20, the angle θ (shown in FIG. 2) may be adjusted. The adjustment of this angle alters the percentage of the exerciser's weight which the excerciser's muscles are moving. This allows for adjustment of the intensity of the exerciser's workout. At the lowest level, the exciser's muscles are moving 5% of the exerciser's body weight; at the highest level the exerciser's muscles are moving 60%. Weight bars (not shown) may be added to the user support platform 28 so that weight plates (not shown) may be positioned on the weight bars, thus adding to the weight propelled by the exerciser's muscles.

An exerciser may also vary the resistance while working upper body muscles by positioning him or herself on the user support platform 28 with the exerciser's feet on the floor. The legs and lower body then provides assistance in moving the user support platform 28 lessening the load on the upper body muscles.

Alternatively, the exerciser may position him or herself on the user support platform 28 with the exerciser's feet positioned on the footrest 36. The exerciser may then extend the exerciser's legs to move the user support platform up along the rails 24, 22.

In an alternate embodiment, an exerciser may lie on the user support platform 28 with the exerciser's foot positioned in the foot rest 42. By bending the exerciser's legs, the exerciser draws the user support platform up along the rails 22, 24.

Furthermore, an exerciser may position himself or herself on the user support platform 28 and grasp the pull-up bars 44. By drawing the exerciser toward the pull-up bars the exerciser is exercising additional muscle groups.

It will be apparent to those skilled in the art that various modifications and variations can be made in the collapsible exercise device of the present invention without departing from the spirit or scope of the invention. Thus, it is intended that the present invention cover the modifications and variations of this invention provided they come within the scope of the appended claims and their equivalents.

We claim:

1. A collapsible exercise device, comprising:

a vertical support member;

a first set of rails, each of said first set of rails having a first end and a second end, the first end of each of said first set of rails being pivotally connected to, and adjustably supported by, said vertical support member;

a second set of rails, each of said second set of rails having a first end and a second end, the first end of each of said second set of rails being pivotally connected at a rail pivot point to the second end of said first set of rails;

a strut with a first end and a second end, the first end of said strut being pivotally connected to said vertical support member and the second end of said strut being pivotally connected to the rail pivot point;

a user support platform with rollers engaging said first and second set of rails, pulley means; and connector means extendable through said pulley means and connecting to said user support platform;

wherein the exercise device is foldable such that said vertical support member, said first set of rails, said second set of rails and said strut are substantially parallel to each other; and wherein said first and second set of rails are extendable from said vertical support member and are alignable such that said user support platform is rollable along said first and second set of rails when said connector means is extended through said pulley means.

2. A collapsible exercise device as claimed in claim 1, wherein said connector means comprises a cable.

3. A collapsible exercise device as claimed in claim 1, further comprising a foot rest positioned perpendicular to said second set of rails at the second end of said second set of rails when said first and second set of rails are extended from said vertical support member and are aligned such that said user support platform is rollable along said first and second set of rails.

4. A collapsible exercise device as claimed in claim 3, wherein said foot rest is removable from said second set of rails.

5. A collapsible exercising device, comprising:

a vertical support member with an upper portion and a lower portion;

a slide bar slidable along, and adjustably supported by said vertical support member, said slide bar having a first side and a second side;

a set of inner rails, each of said set of inner rails having a first end and a second end, and having an inner side and an outer side, the inner side facing the other inner rail and the outer side being the side opposite to the inner side, the first end of one said set of inner rails being pivotally connected to the first side of said slide bar and the other said set of lower rails being pivotally connected to the second side of said slide bar;

a set of outer rails, each of said set of outer rails having a first end and a second end, the first end of each of said outer set of rails being pivotally connected at a rail pivot point to the outer sides of the second end of the inner set of rails;

a strut with a first end and a second end, the first end of said strut being pivotally connected to the lower portion of said vertical support member and the second end of said strut being pivotally connected to the inner sides of the second end of the inner rails at the rail pivot point;

a user support platform with rollers engaging said inner and outer set of rails;

pulley means; and connector means extendable through said pulley means and connecting to said user support platform;

wherein the exercise device is foldable such that said vertical support member, said inner set of rails, said outer set of rails, and such strut are substantially parallel to each other; and wherein said inner and outer set of rails are extendable from said vertical support member and are alignable such that said user support platform is rollable along said inner and outer set of rails when said connector means is extended through said pulley means.

6. A collapsible exercise device as claimed in claim 5, further comprising a set of pulley support bars, one pulley support bar extending from the first side of said slide bar and another pulley support bar extending from the second side of said slide bar and wherein such pulley means comprises a first pulley attached to one pulley support bar, a second pulley attached to the other pulley support bar, and a third pulley attached to the user support platform.

7. A collapsible exercise device as claimed in claim 6, wherein said connector means comprises a cable having a first and second end and further wherein said cable includes a first handle attached to the first end of said cable and a second handle attached to the second end of said cable.

8. A collapsible exercise device as claimed in claim 7, further comprising a foot rest positioned perpendicular to said outer set of rails at the second end of said outer set of rails when said inner and outer set of rails are extended from said vertical support member and are aligned such that said user support platform is rollable along said inner and outer set of rails.

9. A collapsible exercise device as claimed in claim 5, further comprising a roller means supporting said vertical support member such that said vertical support member is rollable when extending the inner and outer set of rails.

10. A collapsible exercise device as claimed in claim 5, further comprising a foot holder positioned on the inner set of rails.

11. A collapsible exercise device as claimed in claim 5, further comprising a pair of pull-up handles attached to the inner set of rails.

12. A collapsible exercise device as claimed in claim 10, wherein said foot holder is removable.

13. A collapsible exercise device as claimed in claim 11, wherein said pull-up handles are removable.

14. A collapsible exercise device as claimed in claim 5, wherein said user support platform is removable from the exercise device when the exercise device is in a folded state.

15. A collapsible exercise device, comprising:

a vertical support member;

a first set of rails, each of said first set of rails having a first end and a second end, the first end of each of said first set of rails being pivotally connected to, and adjustably supported by, said vertical support member;

a second set of rails, each of said second set of rails having a first end and a second end, the first end of each of said second set of rails being pivotally connected at a rail pivot point to the second end of said first set of rails;

a strut with a first end and a second end, the first end of said strut being pivotally connected to the rail pivot point;

a user support platform with rollers engaging said first and second set of rails, pulley means; and connector means extendable through said pulley means and connecting to said user support platform;

wherein the exercise device is foldable such that said vertical support member, said first set of rails, said second set of rails and said strut are substantially parallel to each other; and wherein said first and second set of rails are extendable from said vertical support member and are alignable such that said user support platform is rollable along said first and second set of rails when said connector means is extended through said pulley means and wherein said strut provides support to the rail pivot point when the first and second set of rails are so aligned.

* * * * *

UNITED STATES PATENT AND TRADEMARK OFFICE

CERTIFICATE OF CORRECTION

PATENT NO. : 5,967,955

DATED : October 19, 1999

INVENTOR(S) : Larry Westfall; Thomas A. Walter; James A. Kalthoff; Spencer Mackay It is certified that error appears in the above-identified patent and that said Letters Patent is hereby corrected as shown below:

Title page, item [75], line 5, change "Mackey" to --Mackay--.

Claim 1, column 6, between lines 54 and 55, insert the following line: --a slide on said vertical support member;--.

Claim 1, column 6, line 58, after "said" insert --slide on said--.

Claim 1, column 7, line 9, after "other" insert --by pivoting at said rail pivot point, said first end of said strut, and said second end of said strut–

Claim 1, column 7, line 11, after "said" insert --slide on said--.

Claim 3, column 7, line 21, after "said" insert --slide on said--.

Claim 5, column 7, line 30, delete "bar".

Claim 5, column 7, line 31, delete "bar".

Claim 5, column 7, line 39, delete "bar".

Claim 5, column 7, line 40, delete "bar".

Claim 5, column 7, line 58, change "such" to --said--.

Claim 5, column 7, line 59, after "other" insert --by pivoting at said rail pivot point, said first end of said strut, and said second end of said strut--.

Claim 6, column 8, line 1, after "slide" delete "bar".

Claim 6, column 8, line 3, delete "bar".

UNITED STATES PATENT AND TRADEMARK OFFICE

CERTIFICATE OF CORRECTION

PATENT NO. : 5,967,955

DATED : October 19, 1999

INVENTOR(S) : Larry Westfall; Thomas A. Walter; James A. Kalthoff; Spencer Mackay It is certified that error appears in the above-identified patent and that said Letters Patent is hereby corrected as shown below:

Claim 8, column 8, line 16, before "vertical" insert --slide on said--.

Claim 15, column 8, between lines 37 and 38, insert the following line: --a slide on said vertical support member;--

Claim 15, column 8, line 41, after "said" insert --slide on said--.

Claim 15, column 8, line 57, after "other" insert --by pivoting at said rail pivot point, said first end of said strut, and said second end of said strut--.

Claim 15, column 8, line 59, after "said" insert --slide on said--.

Signed and Sealed this

Second Day of January, 2001

*Attest:*

*Attesting Officer*

Q. TODD DICKINSON

*Commissioner of Patents and Trademarks*